United States Patent [19]

Wadford

[11] 4,104,826

[45] Aug. 8, 1978

[54] DOOR ACTUATING SYSTEM

[76] Inventor: Thomas R. Wadford, 214 Osborne Ave., Baltimore, Md. 21228

[21] Appl. No.: 782,182

[22] Filed: Mar. 28, 1977

[51] Int. Cl.[2] ..... E05F 11/00

[52] U.S. Cl. ..... 49/360; 49/138

[58] Field of Search ..... 49/360, 361, 138, 200; 74/25

[56] References Cited

U.S. PATENT DOCUMENTS

| | | | |
|---|---|---|---|
| 3,039,573 | 6/1962 | Gerhardt | 49/360 X |
| 3,043,584 | 7/1962 | Xielhorn | 49/360 X |
| 3,284,952 | 11/1966 | Lodge | 49/360 |
| 3,533,188 | 10/1970 | Jones et al. | 49/360 |
| 3,834,081 | 9/1974 | Catlett | 49/138 |

*Primary Examiner*—Kenneth Downey

*Attorney, Agent, or Firm*—Morton J. Rosenberg

[57] ABSTRACT

A door actuating system for reversibly displacing a door in a longitudinal direction. Energization of a motor causes frictional engagement of a drive bar which is secured to the door. The drive bar is frictionally driven in a first longitudinal direction to correspondingly displace the door into an open condition. Upon opening of a doorway, the motor is de-energized and a counter-weight drive mechanism is actuated for frictionally driving the drive bar in a second longitudinal direction for closing the doorway.

10 Claims, 3 Drawing Figures

DOOR ACTUATING SYSTEM

BACKGROUND OF THE INVENTION

1. Field of the Invention

This invention pertains to door actuating systems. In particular, this invention pertains to door actuating systems for slidingly opening and displacing door members. More in particular, this invention relates to door actuating systems utilizing frictional drives to open and close the door member. Still further, this invention pertains to door actuating systems which utilize motor drive elements coupled to frictional gripping members for opening the door member. More further, this invention relates to a counter-weight drive mechanism which is frictionally coupled to a drive bar and displaces the door member into a closed position upon deactuation of the motor. Additionally, this invention pertains to a door actuating system which relies upon frictional drive mechanisms to reverseably displace a door member.

2. Prior Art

Door actuating systems for opening and closing doors are known in the art. However, in some prior art door actuating systems, the door member is rotationally swung about a verticle axis. This has the effect of possibly impacting a person who is entering or leaving an enclosure. Thus, in such door systems, a person may be hurt when the door is unsuspectingly opened.

In some prior art door actuating systems, the door member is slidingly moved through use of a pneumatic or hydraulic type actuating device. Such systems are complex in hardware and provide for increased cost of manufacture. Additionally, in such prior actuating systems, due to the nature of hydraulic and/or pneumatic actuation, impact of persons entering or leaving an enclosure may result in the person being hurt. In general, in such prior door actuating systems, the door member does not yield to any great extent upon impact of a person and injury may thus result.

In prior hydraulic/pneumatic type door actuating systems, the actuating elements do not permit the user to open or close the door member when such prior art door actuating systems become jammed in an open or closed position. THus, in some prior art door actuating systems of this type, there is no manual over ride to allow opening or closing of the door member.

SUMMARY OF THE INVENTION

Door actuating system for reversibly displacing a door in a longitudinal direction. The door actuating system includes a motor and a drive bar secured to the door on a first end for displacement of the door responsive to the actuation of the motor. A drive mechanism is frictionally coupled to the drive bar for displacing the drive bar in a first longitudinal direction responsive to the actuation of the motor. A counter-weight drive mechanism is frictionally coupled to the drive bar for displacing the drive bar in a second longitudinal direction responsive to deactuation of the motor.

DESCRIPTION OF THE PREFERRED EMBODIMENTS

Figure 1:
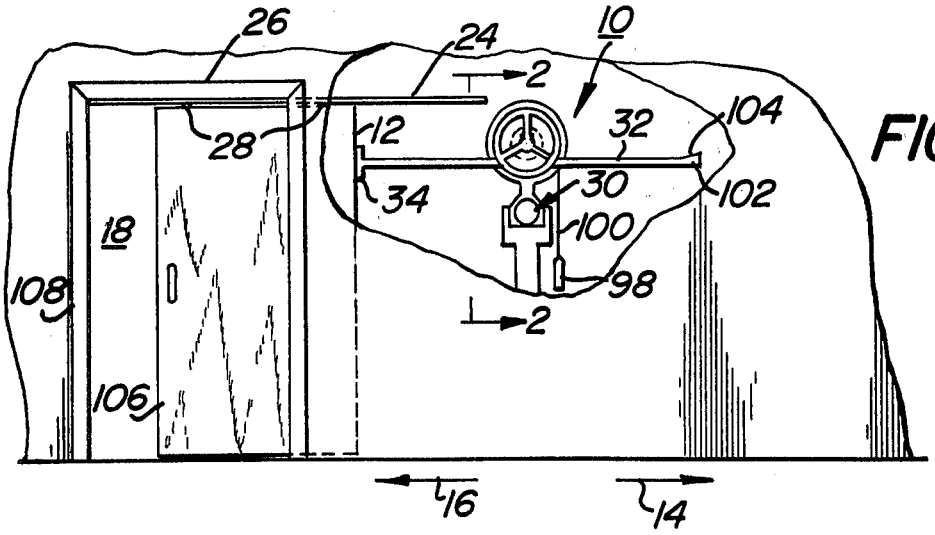
FIG. 1 is an elevational view partially cutaway of the door actuating system.
Figure 2:
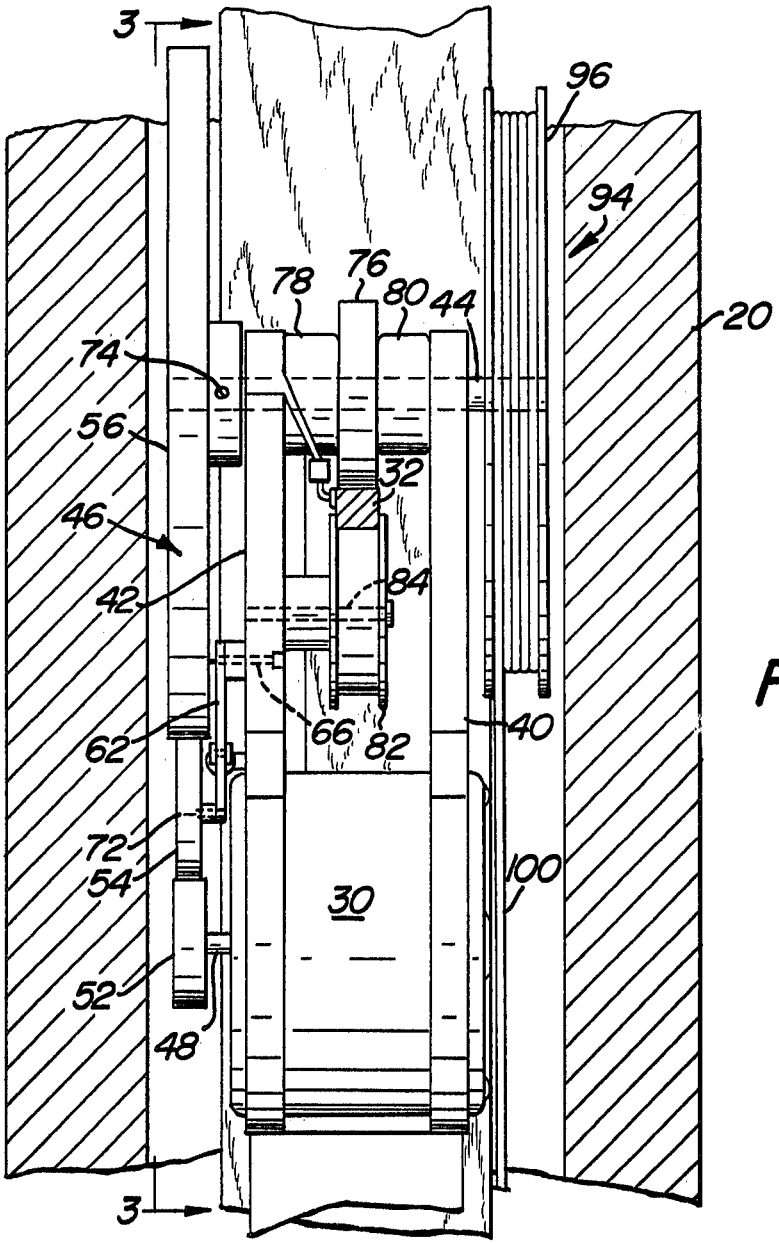
FIG. 2 is a front view of the door actuating system taken along the section line 2—2 of FIG. 1; and, FIG. 3 is a sectional view of the door actuating system taken along the section line 3—3 of FIG. 2.
Figure 3:
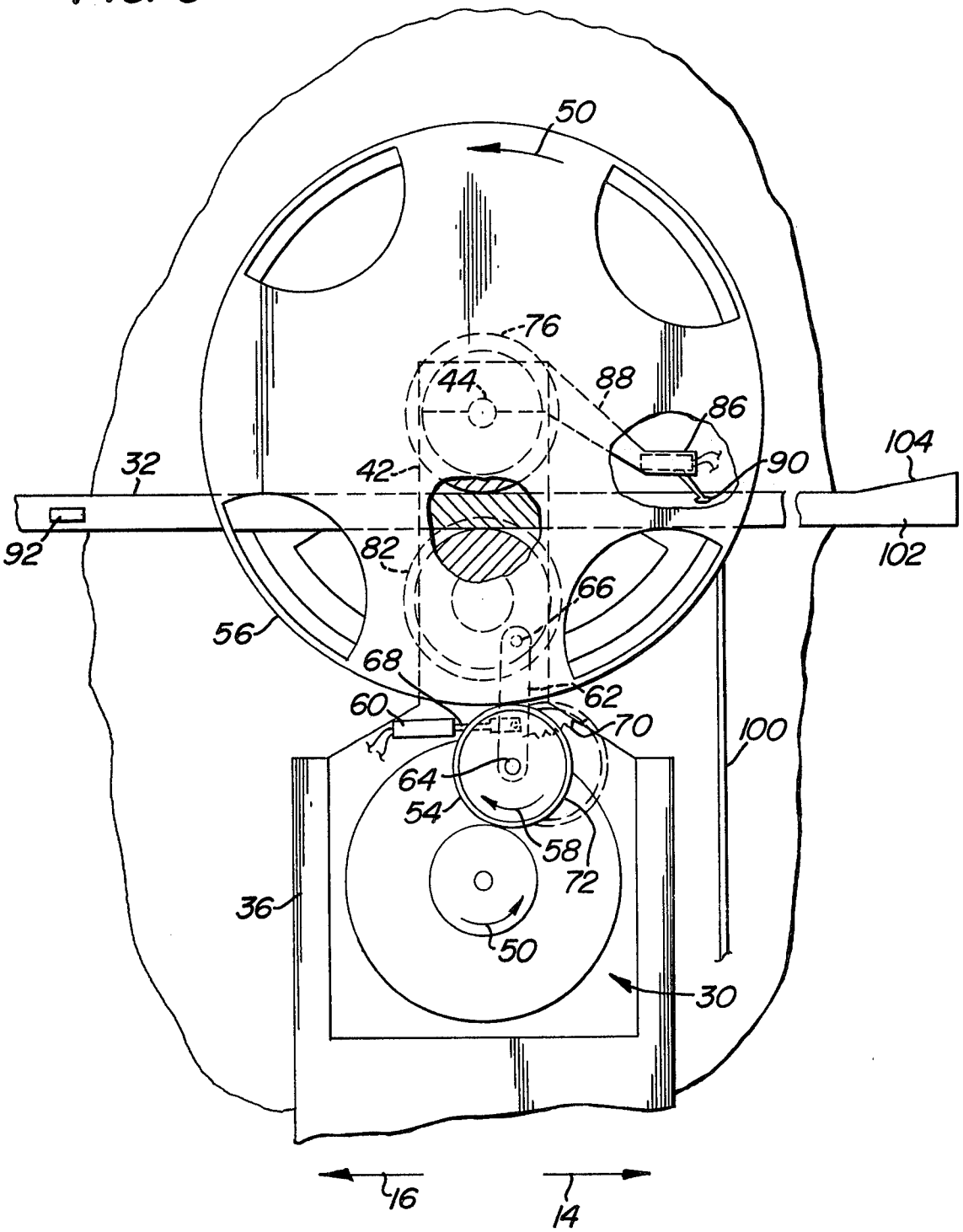

Referring now to FIG. 1–3 there is shown door actuating system 10 for reversibly displacing door 12 in both first longitudinal direction 14 and second longitudinal direction 16. In over all concept, door actuating system 10 upon initial energization causes door 12 to be moved or displaced in first longitudinal direction 14 thereby opening doorway 18 for ingress or egress. Subsequent to opening of doorway 18, door actuating system 10 displaces door 12 in second longitudinal direction 16 thereby closing doorway 18.

Door 12 is movably displaced in longitudinal directions 14 and 16 within opposing transverse wall panels 20 and 22 shown in FIG. 2. Additionally, door 12 may be mounted to longitudinally extending track member 24 which in itself may be secured to door frame 26 and/or one or both of opposing wall panel member 20 and 22. The coupling of door 12 to track member 24 may be through rollers 28 or some like mechanism not important to the inventive concept as is herein described. Thus, door actuating system 10 is seen to be mounted between opposing transverse wall panels 20 and 22 and to further permit door 12 to be slidingly displaced there between in both first longitudinal direction 14 and second longitudinal direction 16, the system and made of operation to be further described in following paragraphs.

Door actuating system 10 includes motor 30 which is the energization source for displacement of drive bar 32 in first longitudinal direction 14. Motor 30 is a standard motor mechanism well known in the art and adapted to be electrically coupled to a standard household voltage outlet. Drive bar 32 is secured to door 12 on first end 34 through bolts, screws, or some like mechanism not important to the inventive concept as is herein described. The important concept being that drive bar 32 is rigidly fastened or secured to door 12 in order that longitudinal displacement of drive bar 32 in first longitudinal direction 14 or second longitudinal direction 16 causes a respective motion or displacement of door 12.

Motor 30 is mounted between opposing transversely opposed panel walls 20 and 22. Additionally, motor 30 may be mounted within frame member 36 which in turn may be mounted to floor 38 and/or to opposing wall panel members 20 and 22. However, the particular mode of attachment of frame 36 is not important to the inventive concept as is herein described with the exception that motor 30 be maintained in a substantially stationary position with respect to floor or base member 38. Frame 36 may include a pair of vertically extending elements 40 and 42 which pass to and are rotatably mounted to a central shaft 44. Vertically extending members 40 and 42 may be mounted to central shaft 44 through rotational bearings or some like mechanism which allows central shaft 44 to freely rotate while maintaining frame member 36 in a stationary position.

In overall concept, drive bar 32 is longitudinally actuated through drive mechanism 46 which is frictionally coupled to drive bar 32 for displacing bar 32 in first longitudinal direction 14 responsive to actuation of motor 30 as will be described in following paragraphs. For purposes of illustration, assume that motor 30 is actuated thereby rotationally displacing motor drive shaft 48 in clock-wise direction 50. Drive roller 52 is rigidly secured to motor drive shaft 48 and is correspondingly driven in clock-wise direction 50 responsive to actuation of motor 30.

Upon actuation of motor 30, idler roller element 54 is displaced to a first position for engaging in frictional contact both drive roller 52 and driven roller 56. As is seen in FIG. 3, idler roller element 54 includes a second position shown in phantom lines where disengagement is provided from drive roller 52 and driven roller 56. Thus, engagement of idler roller element 54 between driven roller 56 and driven roller 52 provides for a frictional mechanism to engage driven roller 56 to drive roller 52. As cam be seen in FIG. 3 actuation of drive roller 52 in counter-clockwise direction 50 causes a clockwise rotation 58 of idler roller 54 which is in frictional engagement with driven roller 56 and is in turn driven in counter-clockwise direction 50.

Idler roller element 54 includes a standard solenoid valve mechanism 60 which is pivotally mounted for idler lug member 62. Idler lug member 62 is rotatably secured to idler roller 54 at pivot 64 defining the center of rotation of idler roller 54. Additionally, idler lug member 62 is rotationally mounted to vertically extending element 42 around pivot connection 66. Solenoid valve 60 is electrically coupled to motor 30 in a standard manner such that actuation of motor 30 causes solenoid piston 68 to be moved in second longitudinal direction 16 for frictional engagement of idler roller 54 between both drive roller 52 and driven roller 56. Deactuation of motor 30 allows solenoid piston 68 to be releasably disengaged from frictional engagement of idler roller 54 between the elements 52 and 56 and allows idler 54 to be movably displaced to the second position of disengagement.

Spring 70 is mounted on one end to idler lug member 62 and on an opposing end to motor frame member 36 in order to provide a biasing mechanism for maintaining idler roller 54 in the second position when motor 30 is deactuated. Thus, as has been described, actuation of motor 30 causes displacement of idler 54 in second longitudinal direction 16 until frictional engagement is achieved between drive roller 52 and driven roller 56. Upon deactuation of motor 30, solenoid valve mechanism 60 releases idler roller 54 from frictional engagement and biasing spring member 70 displaces idler roller 54 in first longitudinal direction 14 into a second position where driven roller 56 is effectively disengaged from drive roller 52. As can be seen in FIG. 2, idler roller element 54 may include rubber strip element 72 secured to a peripheral boundary wall in order to achieve additional frictional contact between idler 54 and opposing rollers 52 and 56. Rubber strip 72 may be formed of rubber or any like material having a high frictional coefficient.

Driven roller 56 is rigidly secured to central shaft 44 through set screw 74 or some like mechanism not important to the inventive concept as is herein described. The important aspect being that rigid securement of driven roller 56 to central shaft 44 causes corresponding rotation of central shaft 44 responsive to rotation of driven roller 56. Displacement of drive bar 32 in logitudinal directions 14 and 16 is performed by friction grip elements which frictionally interfere with opposing upper and lower surfaces of drive bar 32 as is shown in FIGS. 2 and 3. Friction roller 76 is secured to central shaft 44 and correspondingly rotates responsive to the rotation of shaft 44. Friction roller 76 interfaces with an upper surface of drive bar 32 and maybe formed of an aluminum or steel roller surrounded by a hard rubber foam type layer to increase frictional coefficients between drive bar 32 and friction roller 76. Spacers 78 and 80 are positioned between friction roller 76 and opposing vertically extending elements 40 and 42 in order to limit transverse displacement of friction roller 76. Since friction roller 76 is secured to central shaft 44, it is seen that rotation of driven roller 56 in counter-clockwise direction 50 causes a corresponding counter-clockwise rotation of friction roller 76. This has the effect of placing a force loading on drive bar 32 in first longitudinal direction 14.

Pressure guide roller 82 is rotationally mounted to vertically extending frame element 42 as shown in FIG. 2. Shaft 84 allows rotation of pressure guide roller 82 with respect to frame 36. As can be seen, pressure guide roller element 82 interfaces with a lower surface of drive bar 32 thus resulting in drive bar 32 being frictionally gripped between friction roller element 76 and pressure guide roller element 82.

In summary, and for purposes of illustration, motor 30 is initially energized or actuated to cause counter-clockwise rotation of 50 of drive roller 52. Simultaneously, upon actuation of motor 30, solenoid valve mechanism 60 is actuated to drive or displace idler roller element 54 into a first position wherein idler 54 frictionally engages both drive roller 52 and driven roller 56. Counter-clockwise rotation 50 of drive roller 52 causes a clockwise rotation 58 of idler roller element 54 which in turn through frictional engagement causes a counter-clockwise rotation 50 of driven roller 56. Driven roller 56 is secured to central shaft 44 passing in a transverse direction with respect to longitudinal directions 14 and 16. Counter-clockwise rotation 50 of driven roller 56 causes a corresponding counter-clockwise rotation 56 of shaft 44. Friction roller 76 secured to shaft 44 is similarly driven in counter-clockwise rotation 50. Drive bar 32 mounted between friction rollers 76 and pressure guide roller 82 is thus driven in first longitudinal direction 14.

Displacement or microswitch mechanism 86 is secured to frame vertical member 42 through extension element 88 and is rigidly secured thereto. Trip arm 90 is displaced by drive bar lug element 92 as drive bar 32 is driven in first longitudinal direction 14 after doorway 18 is in an open state. Microswitch mechanism 86 is electrically coupled to both solenoid valve 60 and motor 30 in a manner well known in the art, such that displacement of trip arm 90 causes deactuation of motor 30. Thus, as door 12 clears doorway 18, lug 92 actuates microswitch mechanism 86 through movement of trip arm 90 and causes deactuation of motor 30. This results in the termination of rotation of drive roller 52 and a corresponding displacement of idler roller element 54 to a second disengaged position.

Upon deactuation of motor 30, counter-weight drive mechanism 94 which is frictionally coupled to drive bar 32 is actuated for displacing drive bar 32 in second longitudinal direction 16 responsive to deactuation of motor 30. Counter-weight drive mechanism 94 includes counter-weight pulley 96 shown in FIG. 2 which is rigidly secured on common shaft 44. Counter-weight element 98 shown in FIG. 1 is coupled to counter-weight pulley 96 by cable 100 which is rolled around pulley 96. Thus, as drive bar 32 is moved in first longitudinal direction 14 counter-weight pulley 96 is driven in a counter-clockwise direction 50 with a corresponding displacement of counter-weight element 98 in a vertically upward direction. Upon deactuation of motor 30, counter-weight element 98 provides a downward force on pulley 96 to permit rotation of pulley 96 in clockwise direction 58. This rotation causes a coincident and responsive rotation of shaft element 44. Rotation of shaft 44 causes a similar rotation on friction roller 76 and drive bar 32 which is frictionally mounted between friction roller 76 and pressure guide roller 82 is driven in second longitudinal direction 16 in order to close doorway 18.

Drive bar 32 includes second end 102 having an inclined upwardly directed surface 104. Inclined surface 104 serves as a wedge element for increasing frictional contact between drive bar 32 and friction roller 76 and pressure guide roller 82 when such are contacted. This has the effect of diminishing the acceleration of door 12 when door 12 is returned to a closed position. The inclination of incline surface 104 may be in the order of 3° – 10° or an angular inclination sufficient to minimize the displacement speed of door 12 to avoid a banging of door frontal edge surface 106 against frame surface 108. Additionally, frame surface 108 may have included thereon a foam rubber strip to absorb any impact loading by door 12 when such is returned to a closed position.

Although this invention has been described in connection with specific forms and embodiments thereof, it will be appreciated that various modifications other than those discussed above may be restored to without departing from the spirit or scope of the invention. For example, equivalent elemental structures may be substituted for those specifically shown and described, certain features may be used independently of other features, and in some cases, elements may be reversed, all without departing from the spirit or scope of the invention as defined in the appended claims.

What is claimed is:

1. A door actuating system for reversibly displacing a door in a longitudinal direction, comprising:

(a) motor means;

(b) drive bar means secured to said door on a first end for displacement of said door responsive to actuation of said motor means;

(c) drive means being frictionally coupled to said drive bar means for displacing said drive bar means in a first longitudinal direction responsive to said actuation of said motor means, said drive means being rotationally actuatable about at least a first axis line and substantially stationary in said longitudinal direction; and, (d) counterweight drive means being frictionally coupled to said drive means for displacing said drive bar means in a second longitudinal direction responsive to deactuation of said motor means, said counterweight drive means being fixedly coupled to said drive means about said first axis line for rotational actuation of said counterweight drive means to store energy for said second longitudinal displacement of said drive bar means.

2. The door actuating system as recited in claim 1 where said drive means and said counterweight drive means are coupled to said drive bar means by friction grip means being frictionally interfaced to opposing upper and lower surfaces of said drive bar means.

3. The door actuating system as recited in claim 2 where said friction grip means includes:

(a) a friction roller element secured to a rotationally displaceable shaft, said firction roller element interfacing with said upper surface of said drive bar means; and, (b) a pressure guide roller element interfacing with said lower surface of said drive bar means, said drive bar means being gripped between said friction roller element and said pressure guide roller element.

4. The door actuating system as recited in claim 1 where said drive means includes:

(a) drive roller means being rotatably displaceable responsive to actuation of said motor means;

(b) a driven roller element being rotationally displaceable in coupled relation to said drive roller means; and, (c) means for frictionally engaging said driver roller element to said drive roller means.

5. The door actuating system as recited in claim 4 where said frictional engagement means includes an idler roller element displaceable to (1) a first position for engaging said drive roller means and said driven roller element, and (2) a second position for disengaging said drive roller means from said driven roller element.

6. The door actuating system as recited in claim 5 including idler solenoid means for engaging said idler roller element to said drive roller means and said driven roller element responsive to actuation of said motor means.

7. The door actuating system as recited in claim 5 including biasing means for maintaining said idler roller element in said second position when said motor means is deactuated.

8. The door actuating system as recited in claim 1 including displacement switch means secured to said drive bar means and said drive means for deactuation of said motor means subsequent to a predetermined displacement of said drive bar means in said first longitudinal direction.

9. The door actuating system as recited in claim 1 where said drive bar means includes an inclined upwardly directed surface on a second end thereof for diminishing acceleration of said door.

10. The door actuating system as recited in claim 1 where said counterweight drive means includes:

(a) a counterweight pulley element mounted to said drive means on a common shaft; and, (b) a counterweight element coupled to said counterweight pulley element for displacing said drive bar means in said second longitudinal direction responsive to said deactuation of said motor means.

* * * * *